US008014934B2

(12) United States Patent
Layer

(10) Patent No.: US 8,014,934 B2
(45) Date of Patent: Sep. 6, 2011

(54) STARTER DRIVE ASSEMBLY AND METHOD OF STARTING AN ENGINE

(75) Inventor: John Andrew Layer, Fairborn, OH (US)

(73) Assignee: General Electric Company, Schenectady, NY (US)

( * ) Notice: Subject to any disclaimer, the term of this patent is extended or adjusted under 35 U.S.C. 154(b) by 433 days.

(21) Appl. No.: 12/270,670

(22) Filed: Nov. 13, 2008

(65) Prior Publication Data

US 2010/0082218 A1 Apr. 1, 2010

Related U.S. Application Data

(63) Continuation-in-part of application No. 12/240,516, filed on Sep. 29, 2008.

(51) Int. Cl.
*F02N 15/06* (2006.01)
*F02N 7/00* (2006.01)

(52) U.S. Cl. ..... 701/113; 123/179.25; 123/185.6; 123/185.9; 123/179.31; 60/625; 74/7 C; 74/7 D

(58) Field of Classification Search ..... 123/179.31, 123/179.25, 185.6, 185.9; 60/625; 74/7 C, 74/7 D; 701/113
See application file for complete search history.

(56) References Cited

U.S. PATENT DOCUMENTS 2,625,047 A * 1/1953 Wood ..... 74/7 C
2,979,961 A 4/1961 Spencer
2,996,924 A 8/1961 Sabatini
3,319,755 A 5/1967 Digby
3,664,201 A 5/1972 Vogel et al.
3,666,958 A 5/1972 Ruhle et al.
3,690,188 A 9/1972 McMillen
3,691,854 A 9/1972 Barthruff et al.
3,727,733 A * 4/1973 Mrazek ..... 192/42
3,766,453 A 10/1973 Schenk et al.
(Continued)

FOREIGN PATENT DOCUMENTS

DE 846641 8/1952

OTHER PUBLICATIONS

A Communication including an extended European Search Report, dated Jan. 26, 2010 from the European Patent Office, for co-pending European Application No. EP09171403 (6 pages).

*Primary Examiner* — Erick Solis
(74) *Attorney, Agent, or Firm* — David J. Clement, Esq.; Armstrong Teasdale LLP

(57) ABSTRACT

A starter drive assembly includes a starter output shaft having a plurality of circumferentially-spaced axial grooves, a clutch assembly, and a barrel assembly. The clutch assembly includes a clutch plate configured to engage the axially grooves of the output shaft such that the output shaft and the clutch plate rotate together during an engine starting operation. The clutch assembly further includes a screw shaft selectively matingly couplable to the clutch plate, wherein the screw shaft is configured to engage the clutch plate during rotation in a first direction and disengage the clutch plate in a second direction such that the screw shaft and the clutch plate rotate together in the first direction. The barrel assembly includes a first end configured to threadably engage the screw shaft, and a second end that includes a pinion gear configured to engage the ring gear during the engine starting operation.

19 Claims, 6 Drawing Sheets

U.S. PATENT DOCUMENTS

| | | | | |
|---|---|---|---|---|
| 3,820,406 | A | | 6/1974 | Toulier |
| 3,875,805 | A | | 4/1975 | Toulier |
| 4,208,922 | A | | 6/1980 | Mortensen |
| 4,326,429 | A | | 4/1982 | Mortensen |
| 4,366,385 | A | | 12/1982 | Williams |
| 4,369,666 | A | | 1/1983 | Kern |
| 4,395,923 | A | | 8/1983 | Giometti |
| 4,425,812 | A | | 1/1984 | Williams |
| 4,464,576 | A | | 8/1984 | Williams |
| 4,524,629 | A | | 6/1985 | Digby |
| 4,695,735 | A | | 9/1987 | Tallis, Jr. et al. |
| 4,738,148 | A | | 4/1988 | Norton |
| 4,748,862 | A | | 6/1988 | Johnston |
| 4,883,152 | A | | 11/1989 | Froment |
| 4,962,340 | A | | 10/1990 | Isozumi |
| 5,042,312 | A | | 8/1991 | Giometti |
| 5,257,685 | A | * | 11/1993 | Tichiaz et al. ..... 192/46 |
| 5,319,989 | A | * | 6/1994 | Burch ..... 74/7 E |
| 6,247,439 | B1 | * | 6/2001 | Gokan et al. ..... 123/185.6 |
| 6,948,392 | B2 | | 9/2005 | Eckard et al. |
| 7,176,588 | B2 | | 2/2007 | Yahagi et al. |
| 7,302,870 | B2 | | 12/2007 | Vilou et al. |
| 2003/0131817 | A1 | | 7/2003 | Vilou et al. |
| 2006/0082316 | A1 | | 4/2006 | Yahagi et al. |

* cited by examiner

STARTER DRIVE ASSEMBLY AND METHOD OF STARTING AN ENGINE

CROSS REFERENCE TO RELATED APPLICATIONS

This application is a continuation-in-part application of, and claims priority to, U.S. application Ser. No. 12/240,516 filed Sep. 29, 2008 and entitled "Starter Drive Assembly and Method of Starting a Gas Turbine Engine" which is incorporated by reference herein in its entirety.

BACKGROUND OF THE INVENTION

The field of the disclosure relates generally to internal combustion engines, and more particularly, to starter drives for use on such engines.

At least some known internal combustion engines used for power generation include a core engine having a plurality of pistons that translate linearly within a chamber that burns a mixture of fuel and air. This combustion facilitates driving a main shaft that generates torque.

Such engines typically include starter drives used to perform engine start-up operations that facilitate initiating engine rotation, introducing fuel at a proper time to achieve ignition, and accelerating the engine to a self-sustaining ground idle condition. At least some known starters include a starter motor driven by electricity or a compressed air/gas supply to rotate a shaft that is coupled to the starter drive via at least one clutch plate. Such starter drives, commonly known as "inertia drives", typically include a helically threaded shaft upon which a pinion gear is translated. To facilitate starting the engine, the starter motor is driven by a power source of either electricity or compressed air/gas, which in turn drives the output shaft. The rotary motion is coupled through the clutch plates to drive the screw shaft. The inertia of the pinion gear causes it to be translated along the screw shaft into engagement with a ring gear of the engine. Once the pinion gear reaches the end of its travel along the screw shaft, it is fully meshed with the engine ring gear. Continued rotation of the screw shaft rotates the pinion gear, which in turn rotates the ring gear, coupled to a flywheel within the engine to facilitate starting the engine. Following a successful engine ignition, the engine begins to accelerate the ring gear faster than the rotation of the screw shaft. This results in a translation of the pinion gear along the screw shaft away from and out of engagement with the ring gear.

Some known engines use a starter drive that slides over the output shaft of the starter motor and is maintained in position and orientation using a key and set screw combination. In such starter drives, this key and set screw combination may result in an increased component failure rate and decreased reliability for such starter drives. Additionally, such a configuration results in a higher part count and an overall longer starter drive that increases production and maintenance costs while limiting the types of engines on which such starter drives may be used.

BRIEF DESCRIPTION OF THE INVENTION

In one embodiment, an exemplary internal combustion engine is provided. The engine includes a ring gear coupled to a rotatable member of the engine, and a starter drive assembly. The starter drive assembly includes a starter output shaft having a plurality of circumferentially-spaced axial grooves, a clutch assembly, and a barrel assembly. The clutch assembly includes a clutch plate configured to engage the axial grooves of the output shaft such that the output shaft and the clutch plate rotate together during engine starting operation. The clutch assembly further includes a screw shaft selectively matingly couplable to the clutch plate, wherein the screw shaft is configured to engage the clutch plate during rotation in a first direction and disengage the clutch plate in a second direction such that the screw shaft and the clutch plate rotate together in the first direction. The barrel assembly includes a first end configured to threadably engage the screw shaft, and a second end that includes a pinion gear configured to engage the ring gear during the engine starting operation.

In another exemplary embodiment, a starter drive assembly is provided. The starter drive assembly includes a starter output shaft having a plurality of circumferentially-spaced axial grooves, a clutch assembly, and a barrel assembly. The clutch assembly includes a clutch plate configured to engage the axially grooves of the output shaft such that the output shaft and the clutch plate rotate together during engine starting operation. The clutch assembly further includes a screw shaft selectively matingly couplable to the clutch plate, wherein the screw shaft is configured to engage the clutch plate during rotation in a first direction and disengage the clutch plate in a second direction such that the screw shaft and the clutch plate rotate together in the first direction. The barrel assembly includes a first end configured to threadably engage the screw shaft, and a second end that includes a pinion gear configured to engage the ring gear during the engine starting operation.

In yet another exemplary embodiment, a method for starting an engine is provided. The method includes rotating a clutch plate in a first rotational direction such that a plurality of ratchet teeth formed in the clutch plate engage complimentary ratchet teeth in a screw shaft, and rotating the screw shaft using the rotation and engagement such that the screw shaft facilitates translating a barrel assembly in a first axial direction. The method further includes translating the clutch plate in a second axial direction, opposite the first axial direction, compressing a biasing member using the translation of the clutch plate, and engaging a ring gear coupled to a rotatable member of the engine to facilitate starting the engine.

BRIEF DESCRIPTION OF THE DRAWINGS

Non-limiting and non-exhaustive embodiments are described with reference to the following figures, wherein like reference numerals refer to like parts throughout the various views unless otherwise specified.

DETAILED DESCRIPTION OF THE INVENTION

Figure 1:
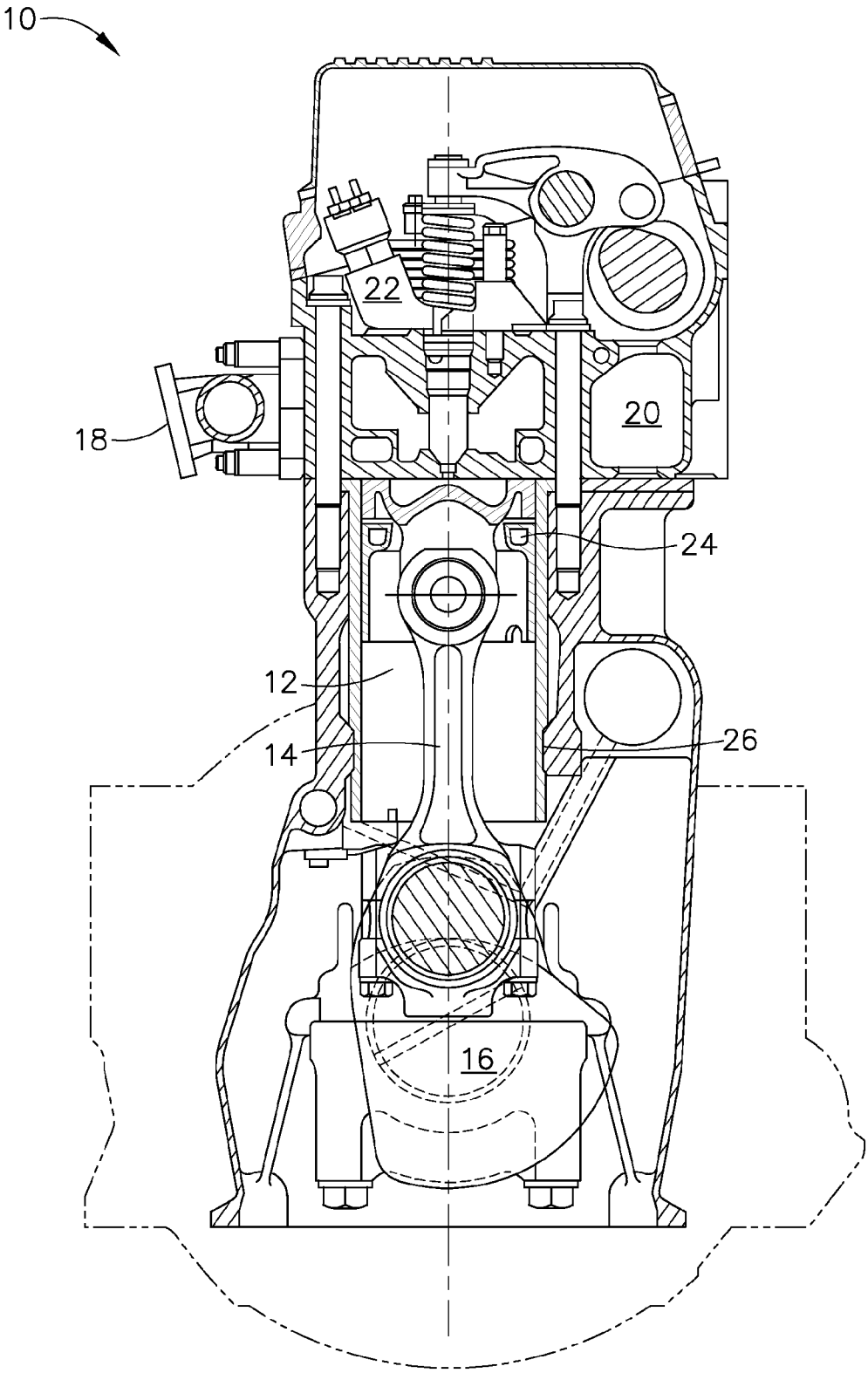
FIG. 1 is a schematic view of an exemplary internal combustion engine.

FIG. 1 is a schematic view of an exemplary intermittent internal combustion engine 10. In the exemplary embodiment, internal combustion engine 10 is a compression-type engine, i.e. a diesel engine, that is characterized by the periodic ignition of discrete quantities of fuel and air. Alternatively, engine 10 may be a continuous-combustion engine, such as a gas turbine engine or a pure jet engine, or an intermittent-combustion engine, such as a spark ignition (gasoline) engine.

In the exemplary embodiment, engine 10 includes a plurality of cylinders 12 coupled to independent connecting rods 14 that are coupled to a crankshaft assembly 16. The combustion process is facilitated by the timing of an exhaust valve/manifold 18, an intake valve/manifold 20 and a fuel injector 22.

During operation, and in the exemplary embodiment, there exists four characteristic combustion phases for engine 10, including the intake stroke, compression stroke, power stroke, and exhaust stroke. During the intake stroke, air intake valve 20 is opened while a piston 24 is moving down to facilitate channeling air into a combustion chamber 26. During the compression stroke, piston 24 begins to move upward and air intake valve 20 closes. As piston 24 moves upward the air is compressed, and fuel is injected into combustion chamber 26 at the end of the compression stroke. The temperature of the compressed air is sufficient to spontaneously ignite the fuel as it is injected into the chamber 26. The high pressure of the explosion facilitates moving piston 24 in a downward motion during the power stroke. The power impulse is transmitted through piston 24, and subsequently through connection rod 14 and to crankshaft assembly 16. Crankshaft assembly 16 is rotated due to the force. During the exhaust stroke exhaust valve 18 opens as piston 24 returns upward following combustion. When piston 24 reaches the top of its travel, exhaust valve 18 closes, and air intake valve 20 opens. In the exemplary embodiment, the four cycles continuously repeating during engine operation.

Figure 2:
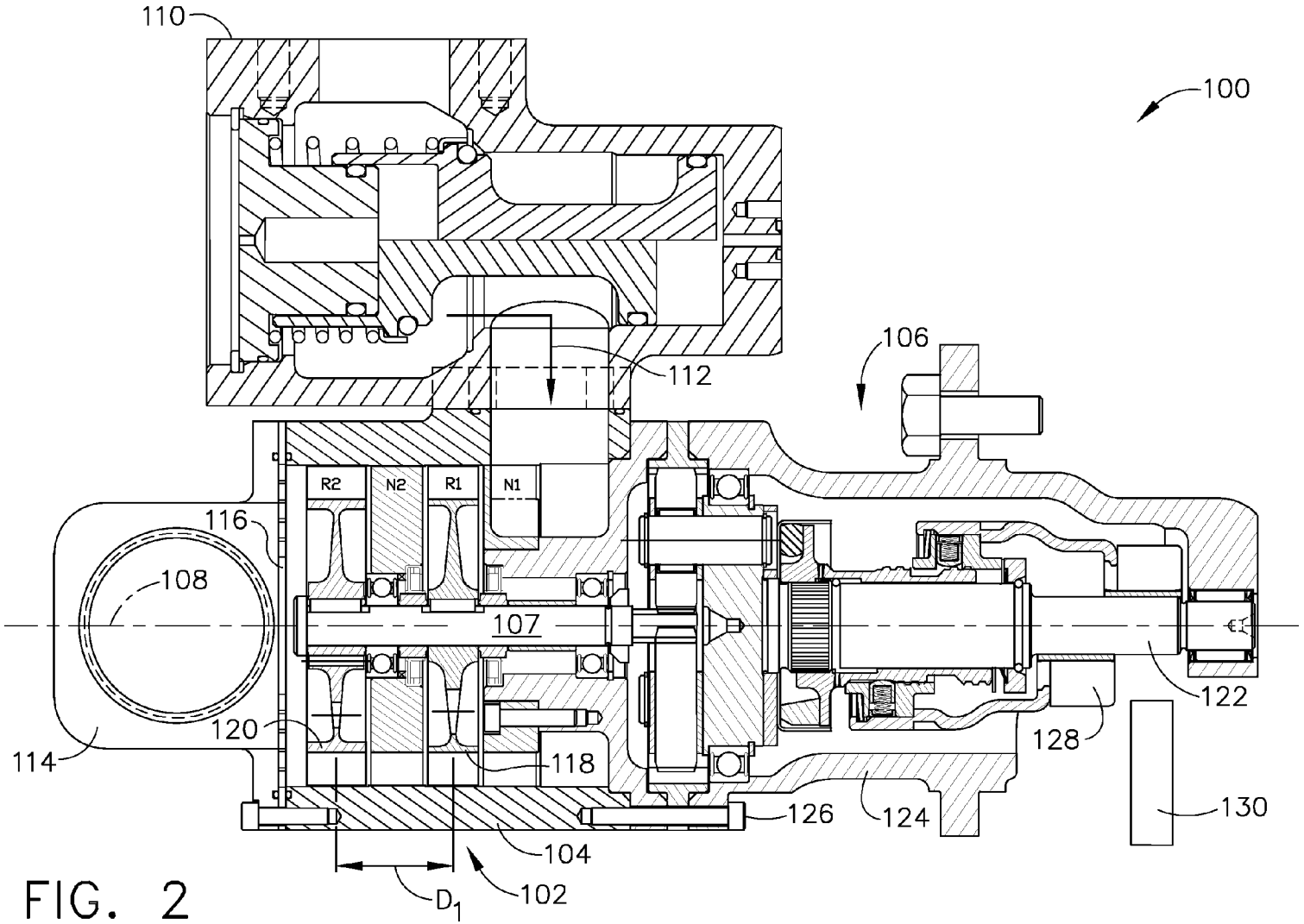
FIG. 2 is a schematic illustration of an exemplary integrated starter system used with the internal combustion engine shown in FIG. 1.

FIG. 2 is a schematic illustration of an exemplary integrated starter system 100 used with the internal combustion engine 10 shown in FIG. 1. In the exemplary embodiment, starter system 100 includes a turbine assembly 102 mounted within a turbine housing 104 that is operatively coupled to a starter drive assembly 106 via a central shaft 107 that includes an axis of rotation 108, wherein turbine assembly 102 is operable to provide torque to starter drive assembly 106 during start-up operations. In the exemplary embodiment, a relay valve 110 is coupled to turbine assembly 102 for use in directing a flow of air 112 into turbine assembly 102. In an alternative embodiment, starter system 100 may not include the relay valve 110. Start system 100 includes an exhaust elbow 114 that extends from a turbine assembly outlet 116 for use in channeling exhaust gas from starter system 100. Turbine assembly 102 includes a first rotor 118 and a second rotor 120 coupled along central shaft 107. More specifically, second rotor 120 is coupled to central shaft 107 a distance $D_1$ downstream along central shaft 107 from first rotor 118 towards turbine assembly outlet 116. Turbine assembly 102 is coupled to starter drive assembly 106 such that axis of rotation 108 is axially aligned with a starter drive assembly driveshaft 122. In the exemplary embodiment, turbine housing 104 is coupled to a starter drive housing 124 via a plurality of pins 126. Alternatively, turbine housing 104 may be coupled to starter drive housing 124 using any type of fastener that enables starter system 100 to function as described herein, including but not limited to, a welded joint and/or at least one bolt. In the exemplary embodiment, starter drive assembly 106 is operable to advance a pinion gear 128 that interfaces with the engine, for example internal combustion engine 10 shown in FIG. 1, via a ring gear 130 in response to applied torque from turbine assembly 102, and retract pinion gear 128 following a successful engine start-up, as will be described in more detail herein.

Figure 3:
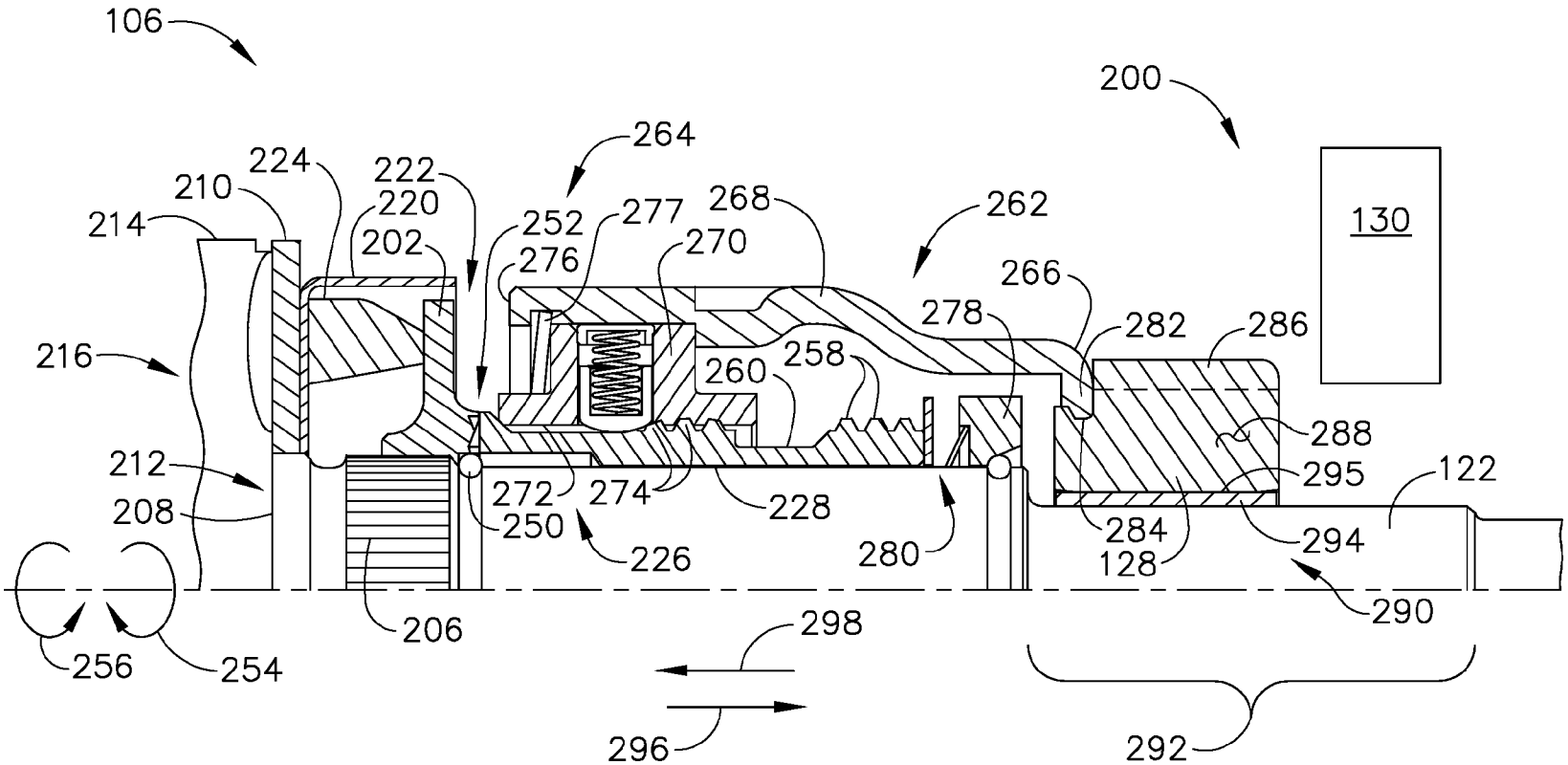
FIG. 3 is a schematic illustration of the starter drive assembly shown in FIG. 2 in a retracted configuration.
Figure 4:
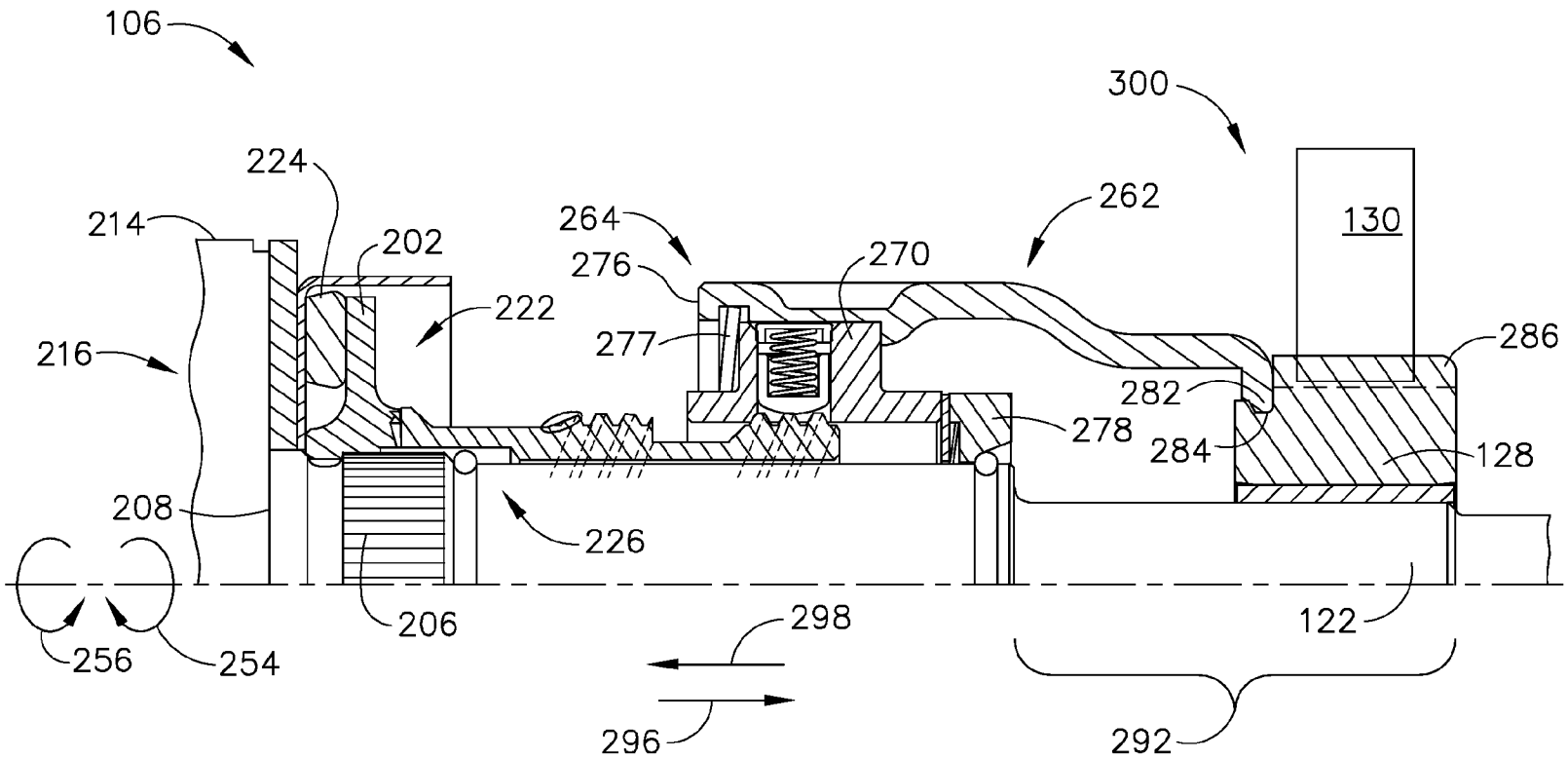
FIG. 4 is a schematic illustration of the starter drive assembly shown in FIG. 2 in an engaged configuration.
Figure 5:
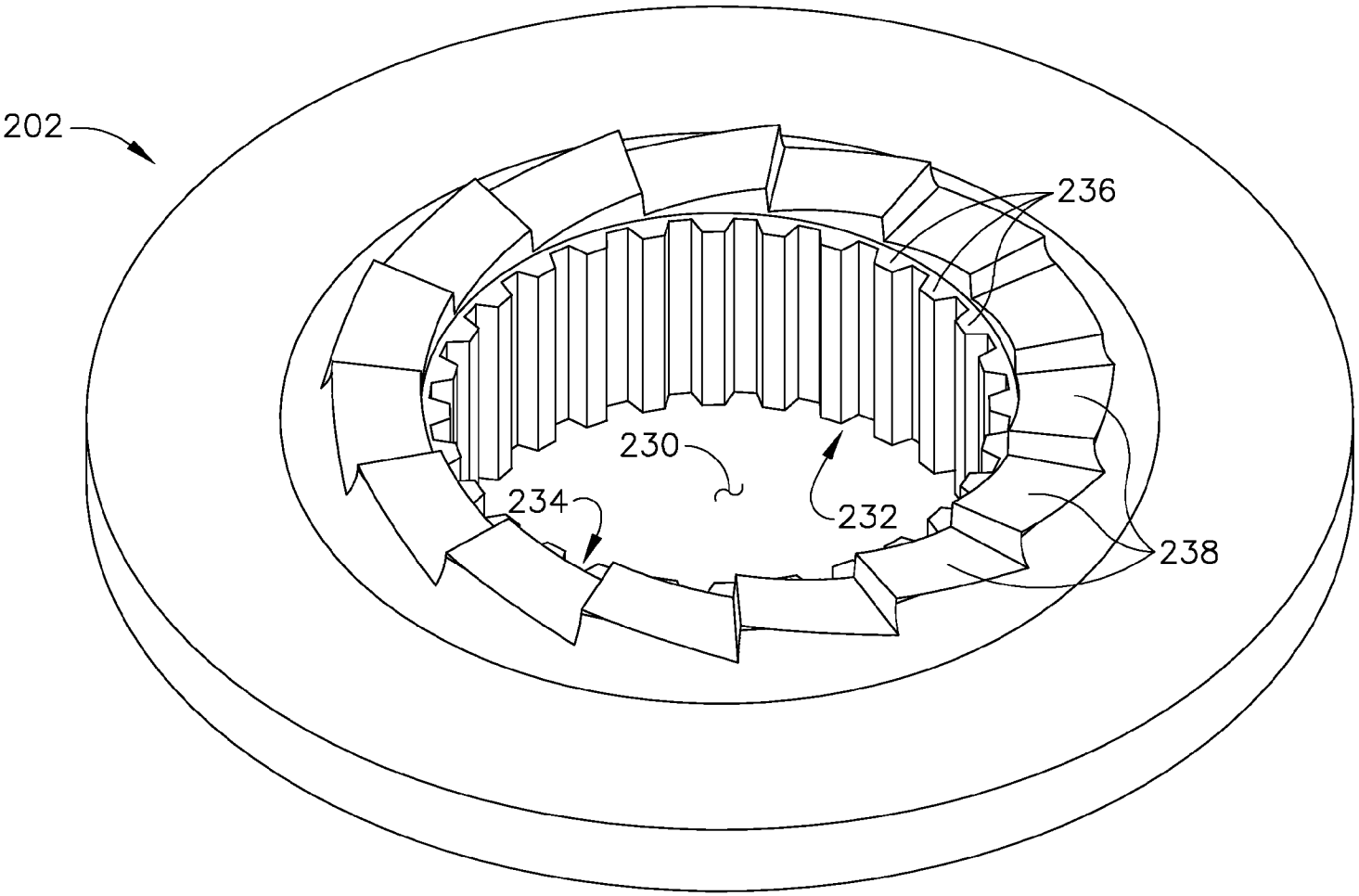
FIG. 5 is a schematic illustration of an exemplary clutch plate.

FIGS. 3 and 4 are schematic illustrations of starter drive assembly 106 in retracted 200 and engaged 300 configurations, respectively. FIG. 5 is a schematic illustration of an exemplary clutch plate 202 used in started drive assembly 106. In the exemplary embodiment, starter drive assembly 106 includes driveshaft 122 used to translate torque being applied from the turbine assembly 102 (shown in FIG. 2) to the engine ring gear 130, as described in more detail herein. More specifically, and in the exemplary embodiment, driveshaft 122 includes a plurality of circumferentially-spaced axially extending grooves 206 positioned adjacent a driveshaft first end 208. A support washer 210 is fixedly coupled to driveshaft first end 208. More specifically, support washer 210 includes an aperture 212 therethrough that is sized and oriented to receive driveshaft first end 208 therein. Alternatively, driveshaft 122 may include any such support feature to facilitate providing a coupling interface at driveshaft first end 208, and that enables starter drive assembly 106 to function as described herein.

In the exemplary embodiment, an engaging flange 214 is fixedly coupled to driveshaft first end 208 and extends axially outward from support washer 210. Engaging flange 214 defines a recess 216 that is sized and oriented to receive a gearing assembly (not shown) therein for use in coupling starter drive assembly 106 to turbine assembly (shown in FIG. 2). More specifically, the gearing assembly positioned within recess enables turbine assembly engages starter drive assembly 106 and provides a torque thereto during start-up operations. In the exemplary embodiment, gearing assembly is a sun/planet/ring gear combination. Alternatively, gearing assembly may be any configuration of gear elements that enables starter system 100 to function as described herein.

A substantially circular casing 220 extends axially inward from support washer 210. In the exemplary embodiment, casing 220 defines a recess 222 that is sized to receive a substantially annular biasing element 224 therein. During use, casing 220 provides support for biasing element 224 and other starter drive components, as described in more detail herein. Additionally, biasing element 224 provides a preload against clutch plate 202 in a direction axially inward from support washer 210, as described in more detail herein, and is configured to compress in order to dampen axial impact loading within starter drive assembly 106 during start-up operations.

In the exemplary embodiment, starter drive assembly 106 includes a clutch assembly 226, which includes an annular clutch plate 202 and cylindrical screw shaft 228, is slidably received on driveshaft 122. More specifically, and referring now to FIG. 5, clutch plate 202 includes an aperture 230 defining an inner surface 232 and a lip 234. In the exemplary embodiment, clutch plate 202 includes a plurality of circumferentially-spaced splines 236 that are disposed around inner surface 232, and a plurality of circumferentially-spaced ratchet teeth 238 adjacent to lip 234. Splines 236 are sized and oriented to engage driveshaft axial grooves 206, such that the driveshaft 122 and clutch plate 202 rotate together during engine start-up operations. In the exemplary embodiment, clutch plate 202 is sized to be received within casing 220 and is biased by biasing element 224, as is shown in FIGS. 3 and 4. This exemplary configuration for starter drive assembly 106 provides an integrated starter system 100 that facilitates consolidating components and reducing system part count into a more efficient and reliable system by eliminating a need for a key/keyway combination, which serves as a point of failure in other known turbine engine starter systems.

Referring again to FIGS. 3 and 4, screw shaft 228 includes a plurality of circumferentially-spaced ratchet teeth 250 along a screw shaft first end 252. Ratchet teeth 250 are sized and oriented to selectively engage clutch plate ratchet teeth 238 during engine start-up operations. More specifically and in the exemplary embodiment, screw shaft 228 engages and rotates with clutch plate 202 during rotation in a first direction 254 and disengages clutch plate 202 during rotation in a second direction 256. In the exemplary embodiment, screw shaft 228 includes a plurality of threads 258 that extend along an external portion 260 of screw shaft 228, wherein threads 258 are sized and oriented to receive and mate with a barrel assembly 262, as described in more detail herein. During engine start-up operations, driveshaft 122, clutch plate 202 and screw shaft 228 rotate as one unit via the corresponding ratchet teeth 238, 250 and the groove/spline combination 206, 236 respectively as shown in FIG. 5. Such a configuration substantially eliminates the need for a separate starter drive as used in other known starter systems by combining component functionality for use during engine start-up operations.

In the exemplary embodiment, barrel assembly 262 is threadably coupled to driveshaft 122 at a barrel assembly first end 264 and pinion gear 128 is fixedly coupled to a barrel assembly second end 266 such that barrel assembly 262 translates pinion gear 128 into contact with engine ring gear 130 during engine start-up operations. More specifically, barrel assembly 262 includes a substantially cylindrical body portion 268 that is sized to extend over screw shaft 228. A control nut 270 is received within barrel assembly first end 264 and includes an inner surface 272 having a plurality of helical splines 274 that correspond and engage screw shaft threads 258. In the exemplary embodiment, control nut 270 is maintained in position within barrel assembly 262 by a radially inwardly extending flange 276 and a snap ring 277. Alternatively, control nut 270 may be coupled within barrel assembly 262 using any fastener device or method that enables starter system 100 to function as described herein, including but not limited to bolting, welding, and/or via an adhesive or any combination thereof. In the exemplary embodiment, a control nut stop 278 is coupled to a screw shaft second end 280 and engages control nut 270 during operations. More specifically, control nut stop 278 defines an end of axial travel for barrel assembly 262 as pinion gear 128 is translated into contact with engine ring gear 130.

In the exemplary embodiment, pinion gear 128 is coupled to barrel assembly 262 via a coupling flange 282 that extends radially inward from barrel assembly second end 266 and is received within a receptacle 284 defined on pinion gear 128. Alternatively, pinion gear 128 may be coupled to barrel assembly second end 266 using any fastener device or method that enables starter system 100 to function as described herein, including but not limited to bolting, welding, and/or via an adhesive or any combination thereof. A plurality of circumferentially-spaced gear teeth 286 are disposed along a pinion gear outer surface 288 that enables pinion gear 128 to engage engine ring gear 130. Pinion gear 128 includes an axially-aligned aperture 290 therethrough that is sized to receive and translate along a portion 292 of driveshaft 122. In the exemplary embodiment, a bushing 294 is included along an inner surface 295 of pinion gear aperture 290 to facilitate reducing friction during rotation and to facilitate easily translating pinion gear 128 along driveshaft 122 during engine start-up operations. Alternatively, bushing 294 may not be included within pinion gear aperture 290, but instead a lubricant, a film and/or a lining, or combination thereof may be used to reduce friction therein and facilitate translating pinion gear 128 during start-up operations.

During use, prior to commencing engine start-up operations, starter drive assembly 106 is in the retracted position, as shown in FIG. 3. Turbine assembly 102 (shown in FIG. 2) will transmit a torque along driveshaft 122 to spin driveshaft 122 in a start-up direction 254. As a result of the applied torque driveshaft 122 and clutch assembly 226 (including clutch plate 202 and screw shaft 228) rotate as one unit via the corresponding ratchet teeth and groove configurations described herein. As clutch assembly 226 rotates, barrel assembly 262 is translated via spline/threads combination in a first direction 296, thereby translating pinion gear 128 into contact with engine ring gear 130 and into the engaged configuration 300 shown in FIG. 4. Clutch assembly is allowed to translate in a second direction 298 and is biased by biasing member 224 which compresses during start-up operations (as shown in FIG. 4) to facilitate dampening impact loading imparted upon starter drive assembly 106 by the translated torque. Such a starter drive system design eliminates the need for a key/keyway combination typically used to couple known starter drives to driveshafts, thereby reducing the overall drive assembly length and enabling such a system to be used on a wider range of engines.

Figure 6:
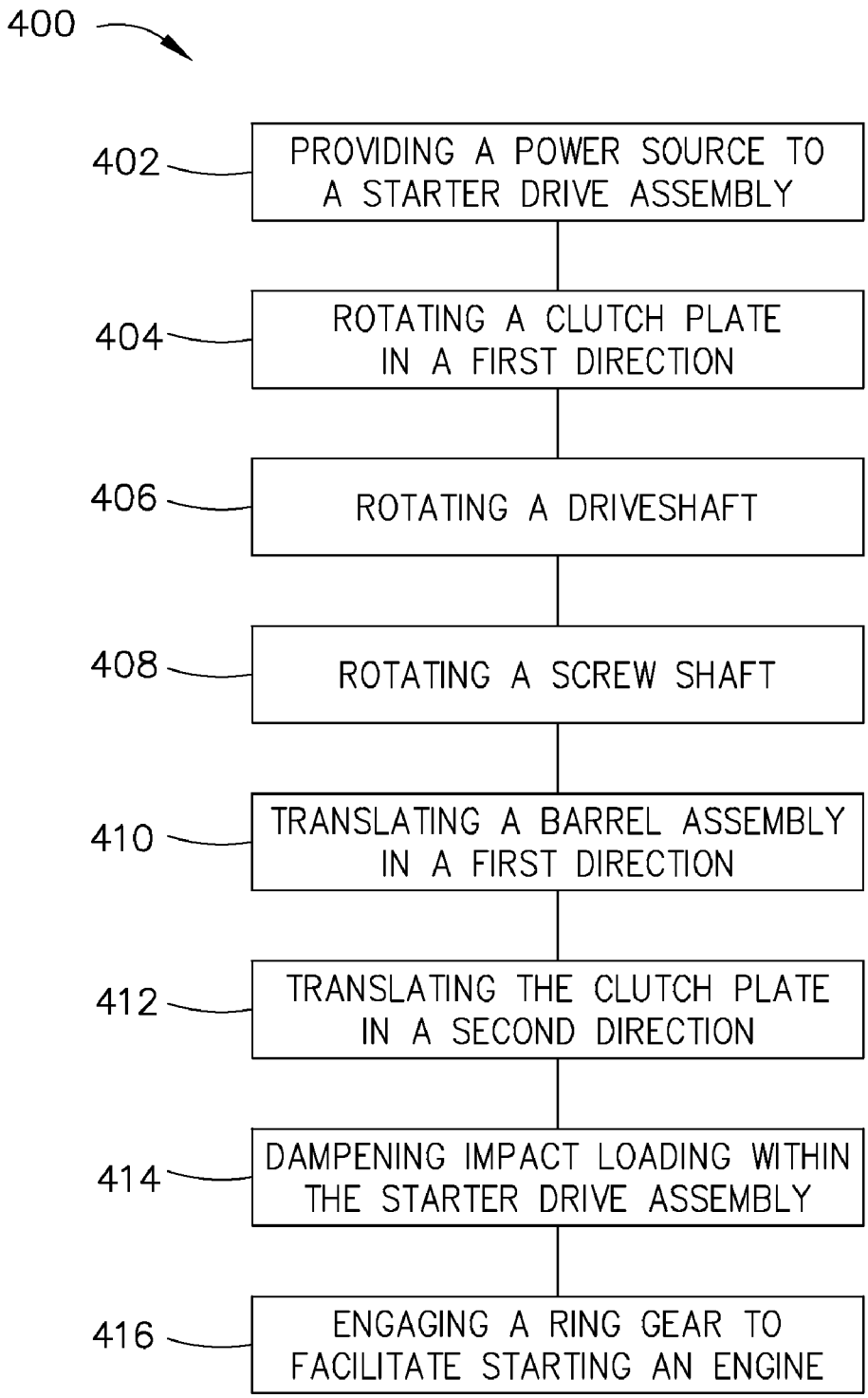
FIG. 6 is a flow diagram of an exemplary method for starting an engine, such as for example, the internal combustion engine shown in FIG. 1.

FIG. 6 is a flow diagram of an exemplary method 400 for starting an gas turbine engine, such as for example, internal combustion engine 10 shown in FIG. 1, although method 400 may be used to for starting any engine. In the exemplary embodiment, method 400 includes providing 402 a power source to a starter drive assembly, and thereby rotating 404 a clutch plate in a first rotational direction such that a plurality of ratchet teeth formed in the clutch plate engage complimentary ratchet teeth in a screw shaft, and rotating 406 a starter driveshaft coupled to the clutch plate via a plurality of circumferentially-spaced axial grooves.

In the exemplary embodiment, method 400 includes rotating 408 the screw shaft using the rotation 404 of the clutch plate and engagement with the clutch plate such that the screw shaft facilitates translating 410 a barrel assembly in a first axial direction, and translating 412 the clutch plate in a second axial direction, opposite the first axial direction.

In the exemplary embodiment, method 400 includes compressing 414 a biasing member using the translation of the clutch plate such that impact loading within the starter drive assembly is dampened. Following translation of the barrel assembly and translation of the clutch plate, in the exemplary embodiment, a ring gear coupled to a rotatable member of the engine is engaged 416 by the starter drive assembly to facilitate starting the engine.

Exemplary embodiments of starter drives for use in combustion engines are described in detail above. The above-described integrated start drive assemblies use a starter driveshaft and clutch assembly combination to facilitate consolidating components and reducing system part count into a more efficient and reliable system. Such results are accomplished while maintaining a preloaded condition within the starter drive assembly and by creating a more stable load path throughout the starter drive assembly. More specifically, by essentially combining the consolidated clutch assembly with the starter driveshaft via corresponding grooves on the components, the need for a separate starter drive is eliminated. Furthermore, such an integrated system eliminates the need for a key/keyway combination, which served as a point of failure in other known systems. This reduction and consolidation of parts, as described herein, facilitates reducing the overall drive assembly length and therefore enables such a system to be used on a wider range of engines, especially those with smaller, more confined spaces. Additionally, such an integrated system provides a more reliable system with fewer components that has an overall smaller size when compared with known starter drive systems, while reducing costs during manufacture and assembly. The exemplary system designs disclosed herein provide an easily maintainable starter drive that may be quickly installed during engine assembly operations, and/or removed during maintenance and servicing operations. Such a design substantially reduces the likelihood of component failure within the starter drive assembly typically associated with other known, more complex systems.

Although the foregoing description contains many specifics, these should not be construed as limiting the scope of the present invention, but merely as providing illustrations of some of the presently preferred embodiments. Similarly, other embodiments of the invention may be devised which do not depart from the spirit or scope of the present invention. Features from different embodiments may be employed in combination. The scope of the invention is, therefore, indicated and limited only by the appended claims and their legal equivalents, rather than by the foregoing description. All additions, deletions and modifications to the invention as disclosed herein which fall within the meaning and scope of the claims are to be embraced thereby.

Although the apparatus and methods described herein are described in the context of starter drive assemblies for use with internal combustion engines, it is understood that the apparatus and methods are not limited to internal combustion engine applications. Likewise, the system components illustrated are not limited to the specific embodiments described herein, but rather, system components can be utilized independently and separately from other components described herein.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An engine comprising:

a ring gear coupled to a rotatable member of the engine;

a starter drive assembly comprising:

a starter output shaft including a first end and a second end, said first end comprising a plurality of axial grooves circumferentially-spaced and extending from said first end axially toward said second end;

a clutch assembly comprising:

a clutch plate configured to engage the axial grooves of said output shaft such that said output shaft and said clutch plate rotate together during an engine starting operation; and a screw shaft selectively matingly couplable to said clutch plate, said screw shaft configured to engage said clutch plate during rotation in a first direction and disengage said clutch plate in a second direction such that said screw shaft and said clutch plate rotate together in the first direction;

a barrel assembly comprising:

a first end configured to threadably engage said screw shaft; and a second end comprising a pinion gear configured to engage said ring gear during the engine starting operation.

2. An engine in accordance with claim 1, wherein said clutch plate further comprises:

an aperture including an inner surface and a lip;

a plurality of splines circumferentially-spaced around the inner surface, said plurality of splines configured to engage said axial grooves of said output shaft; and a plurality of ratchet teeth circumferentially spaced adjacent to the lip of said aperture.

3. An engine in accordance with claim 2, wherein said screw shaft is sized to receive said starter output shaft therethough, said screw shaft configured to couple to said clutch plate via a plurality of corresponding ratchet teeth.

4. An engine in accordance with claim 1, wherein said barrel assembly further comprises a control nut fixedly coupled to said first end and configured to threadably engage said screw shaft.

5. An engine in accordance with claim 4, further comprising a control nut stop circumscribing said starter output shaft and configure to define an end of axial travel of said barrel assembly along said starter output shaft.

6. An engine in accordance with claim 1, further comprising a bushing extending along at least a portion of said starter output shaft configured to facilitate reducing friction between said starter output shaft and said barrel assembly.

7. An engine in accordance with claim 1, further comprising a casing coupled to said first end of said output shaft, said casing extending over at least a portion of said first end and at least a portion of said clutch assembly such that a recess is defined between said casing and said clutch assembly.

8. An engine in accordance with claim 7, further comprising a substantially circular biasing member positioned within said recess and configured to provide a preload to said clutch plate and configured to compress during starting operations to facilitate damping impact loading within said starter drive assembly.

9. A starter drive assembly for an engine, said starter drive assembly comprising:

a starter output shaft including a first end and a second end, said first end comprising a plurality of axial grooves circumferentially-spaced and extending axially toward said second end;

a clutch assembly comprising:

a clutch plate configured to engage the axially grooves of said output shaft such that said output shaft and said clutch plate rotate together during an engine starting operation; and a screw shaft selectively matingly couplable to said clutch plate, said screw shaft configured to engage said clutch plate during rotation in a first direction and disengage said clutch plate in a second direction such that said screw shaft and said clutch plate rotate together in the first direction;

a barrel assembly comprising:

a first end configured to threadably engage said screw shaft; and a second end comprising a pinion gear configured to engage said ring gear during the engine starting operation.

10. A starter drive assembly in accordance with claim 9, wherein said clutch plate further comprises:

an aperture including an inner surface and a lip;

a plurality of splines circumferentially-spaced around the inner surface, said plurality of splines configured to engage said axial grooves of said output shaft; and a plurality of ratchet teeth circumferentially spaced adjacent to the lip of said aperture.

11. A starter drive assembly in accordance with claim 10, wherein said screw shaft is sized to receive said starter output shaft therethough, said screw shaft configured to couple to said clutch plate via a plurality of corresponding ratchet teeth.

12. A starter drive assembly in accordance with claim 9, wherein said barrel assembly further comprises a control nut fixedly coupled to said first end and configured to threadably engage said screw shaft.

13. A starter drive assembly in accordance with claim 12, further comprising a control nut stop circumscribing said starter output shaft and configure to define an end of axial travel of said barrel assembly along said starter output shaft.

14. A starter drive assembly in accordance with claim 9, further comprising a bushing extending along at least a portion of said starter output shaft configured to facilitate reducing friction between said starter output shaft and said barrel assembly.

15. A starter drive assembly in accordance with claim 9, further comprising a casing coupled to said first end of said output shaft, said casing extending over at least a portion of said first end and at least a portion of said clutch assembly such that a recess is defined between said casing and said clutch assembly.

16. A starter drive assembly in accordance with claim 15, further comprising a substantially circular biasing member positioned within said recess and configured to provide a preload to said clutch plate and configured to compress during engine starting operation to facilitate damping impact loading within said starter drive assembly.

17. A method for starting an engine, said method comprising:

rotating a clutch plate in a first rotational direction such that a plurality of ratchet teeth formed in the clutch plate engage complimentary ratchet teeth in a screw shaft;

rotating the screw shaft using the rotation and engagement such that the screw shaft facilitates translating a barrel assembly in a first axial direction;

translating the clutch plate in a second axial direction, opposite the first axial direction;

compressing a biasing member using the translation of the clutch plate;

rotating a starter output shaft coupled to the clutch plate via a plurality of circumferentially-spaced axial grooves formed proximate a first end of the starter output shaft; and engaging a ring gear coupled to a rotatable member of the engine to facilitate starting the engine.

18. A method for starting an engine in accordance with claim 17, wherein rotating the screw shaft further comprises threadably translating a barrel assembly in a first axial direction.

19. A method for starting an engine in accordance with claim 17, wherein compressing a biasing member further comprises damping impact loading within the starter drive assembly.

* * * * *